US005245196A

United States Patent [19]

Cabalfin

[11] Patent Number: 5,245,196

[45] Date of Patent: Sep. 14, 1993

[54] INFRARED FLAME SENSOR RESPONSIVE TO INFRARED RADIATION

[75] Inventor: Roland V. Cabalfin, Anaheim, Calif.

[73] Assignee: Hydrotech Chemical Corporation, City of Industry, Calif.

[21] Appl. No.: 752,073

[22] Filed: Aug. 29, 1991

[51] Int. Cl.[5] ..... G01J 31/14

[52] U.S. Cl. ..... 250/554; 250/338.1

[58] Field of Search ..... 250/554, 338.1, 339, 250/338.3; 340/578

[56] References Cited

U.S. PATENT DOCUMENTS

| | | | |
|---|---|---|---|
| 3,316,409 | 4/1967 | Rockwell | 340/578 |
| 3,742,474 | 6/1973 | Muller | 340/578 |
| 4,639,717 | 1/1987 | De Meirsman | 250/554 |

*Primary Examiner*—David C. Nelms
*Assistant Examiner*—Que T. Le
*Attorney, Agent, or Firm*—Woodard, Emhardt, Naughton, Moriarty & McNett

[57] ABSTRACT

An infrared flame sensor apparatus useful for detecting a flame in the combustion chamber of a water heater or boiler is disclosed. An infrared phototransistor with narrow light frequency response detects the infrared components emitted by the flame. A flame signal proportional to the amount of infrared radiation detected is generated. The flame signal is filtered to remove transients that may give a false or oscillatory signal indication. When the amplitude of the flame signal is in excess of a predetermined amplitude an indicator is illuminated or an alarm is activated.

12 Claims, 2 Drawing Sheets

INFRARED FLAME SENSOR RESPONSIVE TO INFRARED RADIATION

BACKGROUND OF THE INVENTION

The present invention relates in general to a flame sensing circuit. More particularly, the present invention relates to an apparatus useful for detecting a flame in the combustion chamber of a water heater or boiler by sensing the infrared components of the light emanating from the flame.

Many methods of detecting a flame are known. U.S. Pat. No. 2,911,540 to Powers discloses a flame detection system incorporating a photoconductive cell such as a cadmium sulfide cell which is electrically sensitive to flame. The cell is connected through a high resistance to a direct current voltage source in such a manner that when and as the intensity of the radiation increases, the voltage across the cell decreases. The voltage which is developed across the cell may be considered to consist of two components. The first component is a substantially continuous unidirectional voltage representative of the average light intensity of the radiation and the second component varies in accordance with sporadic fluctuations in the intensity of such flame. The frequency of flame fluctuation is approximately 25 Hz. The voltage developed across the cell is applied to a unique amplifying system which is tuned to a frequency of approximately 25 Hz so as to selectively amplify that component of the voltage representative of the sporadic fluctuations.

U.S. Pat. No. 3,727,073 to Cade discloses a flame sensor control circuit. The preferred embodiment of this invention features a control apparatus for a burner. Cade utilizes a flame rod detector that provides a signal to an electronic amplifier, which in turn operates multiple relays responsive to the flame rod detector signal.

U.S. Pat. No. 3,742,474 to Muller discloses a flame detector. The Muller flame detector comprises a photosensitive transducer such as a photocell, a photodiode or a photoresistance located so as to be sensitive to the radiation omitted by the flame. The phototransducer is designed to provide an electrical output signal. The remainder of the detector circuit is designed to indicate the presence of a flame by producing an alarm or control signal. Muller discloses a device that discriminates between radiation from a flame and from spurious radiation by selecting the higher proportion of infrared radiation which is present when flames arise due to a fire. A red sensitive and blue sensitive photocell are serially connected, and an electrical circuit arranged so that an alarm signal is derived only when the red-blue ratio exceeds a predetermined value. The Muller device includes a filter for passing frequencies within a predetermined bandwidth, for example 5 to 25 hertz or 2 to 40 hertz.

U.S. Pat. No. 3,820,097 to Larson discloses a flame detection system with compensation for the flame detector. Larson teaches the use of a flame responsive impedance, such as a lead sulfide photocell, which responds to a change in infrared radiation and the flame flicker frequency of a sensed flame. The flame flicker frequency is normally in the 6 to 15 Hertz range. The system normally is tuned by a bandpass amplifier in a range up to approximately 15 to 18 Hertz. The flame flicker signal is amplified and used to control an output switch.

U.S. Pat. No. 4,395,638 to Cade discloses a self-checking flame failure control of the type which continuously monitors its own performance so as to be self-checking, i.e., to produce a response whenever the system shows the absence of a condition being monitored or a change therein. Cade also produces a response if the control system itself should become inoperative or otherwise malfunction. Cade teaches the use of two sensors capable of sensing the same event and producing two separate but comparable signals indicating the presence of the event and, conversely, the absence of such signal to indicate the absence of the event. Two photodetectors are respectively connected in series with resistors which are connected in series across an appropriate DC power supply. The photo detectors effectively change resistance upon reception of radiation energy. Comparable signals appear on two separate lines when the same event, i.e., the presence of a flame, is sensed by the photodetectors. The comparable signals are compared by a voltage comparator, the output of which is amplified and applied to a Schmidt trigger. If a flame is present, the comparison will indicate comparable signals.

U.S. Pat. No. 4,591,725 to Bryant discloses a system for amplifying all frequencies present in a signal detected from a flame detector. A photodetector provides a signal corresponding to flame intensity and includes signal components attributable to flame flicker. A photovoltaic light detector, usually a silicon diode, is employed to generate a signal in response to light impinging upon it. When the light comes directly from the axial midportion of a flame, the intensity of the light will vary according to a flicker frequency and, therefore, the signal from the detector has the flicker frequency superimposed on it. All frequencies down to D.C., including flame flicker frequency as well as D.C., are amplified equally. The signals are then processed further downstream in order to isolate the flicker frequencies for the purpose of indicating a flame-on condition in the conventional manner.

U.S. Pat. No. 4,639,717 to DeMeirsman discloses a method and apparatus for monitoring flame conditions. This reference discloses a flame monitor that senses flame brightness and produces two signals corresponding to rapid brightness variations and average brightness. By comparing rapid signal variations to a fraction of the average signal, a threshold ON-OFF signal representing normal flame operation is obtained that can be processed as a fail-safe indication and control. High and low limit thresholds can be set and compared with average brightness as a further condition of proper flame operation.

U.S. Pat. No. 4,904,986 to Pinckaers discloses an infrared flame amplifier. A flame sensor circuit controls the flow of fuel to the burner or boiler. A photocell is used to produce a flame signal when the photocell is exposed to a flame. An input circuit is coupled to the photocell for receiving and buffering the flame signal. The buffered flame signal is filtered and amplified in a filter. An output circuit further amplifies the filtered flame signal providing an output flame signal. Pinckaers teaches the use of an infrared sensitive lead sulfide cell for detecting a flame and producing a corresponding flame signal. Switch means are coupled to the lead sulfide cell for substantially short circuiting the flame signal to a known value upon receiving a switch-close signal. Hot refractory detection means are also coupled to the photocell for detecting a flame-out condition and generating a hot refractory detection signal causing the flame signal to be substantially short circuited to a known value thereby eliminating a false flame signal caused by hot refractory shimmering.

German Patent DL-140-170 to Rauschenbach discloses a circuit used to detect the presence of a flame. The Rauschenbach device includes an optoelectronic component, namely a phototransistor, a MOSFET amplifier and an RC element filter with a time constant tuned to the flame ignition frequencies. The sensitivity of the filter is greatest at the flame frequency range to minimize the effects of stray radiation pickup.

A more economical and easily manufactured flame sensor is needed for applications wherein remote flame detection is desired.

SUMMARY OF THE INVENTION

A flame sensing apparatus, according to one aspect of the present invention, for detecting the infrared components of a flame present in the combustion chamber of a water heater or boiler comprises a phototransistor disposed in close proximity to the flame and having a response at wavelengths primarily in the infrared spectrum, the phototransistor having an emitter terminal and a collector terminal, filter means for filtering out transient signals in order to prevent false or oscillatory signal indications from occurring in response to a signal from the phototransistor, the filter means having a filter input and a filter output, the emitter terminal connected to the input of the filter, switch means having a switch input and a switch output, the filter output connected to the switch input, the switch conducting in response to signals appearing at the input terminal, monitoring means connected to the switch output for indicating the presence of a signal in excess of a predetermined amplitude at the switch output.

One object of the present invention is to provide a means for monitoring infrared radiation indicative of flame presence in a combustion chamber.

Another object of the present invention is to provide an apparatus for detecting the presence of a flame which is economical to manufacture.

A further object of the present invention is to provide an apparatus which selectively eliminates transient interference from the detected infrared signal to provide a reliable indication of flame presence.

Other objects and advantages of the present invention will become more apparent from the following description of the preferred embodiment.

DESCRIPTION OF THE PREFERRED EMBODIMENT

Figure 1:
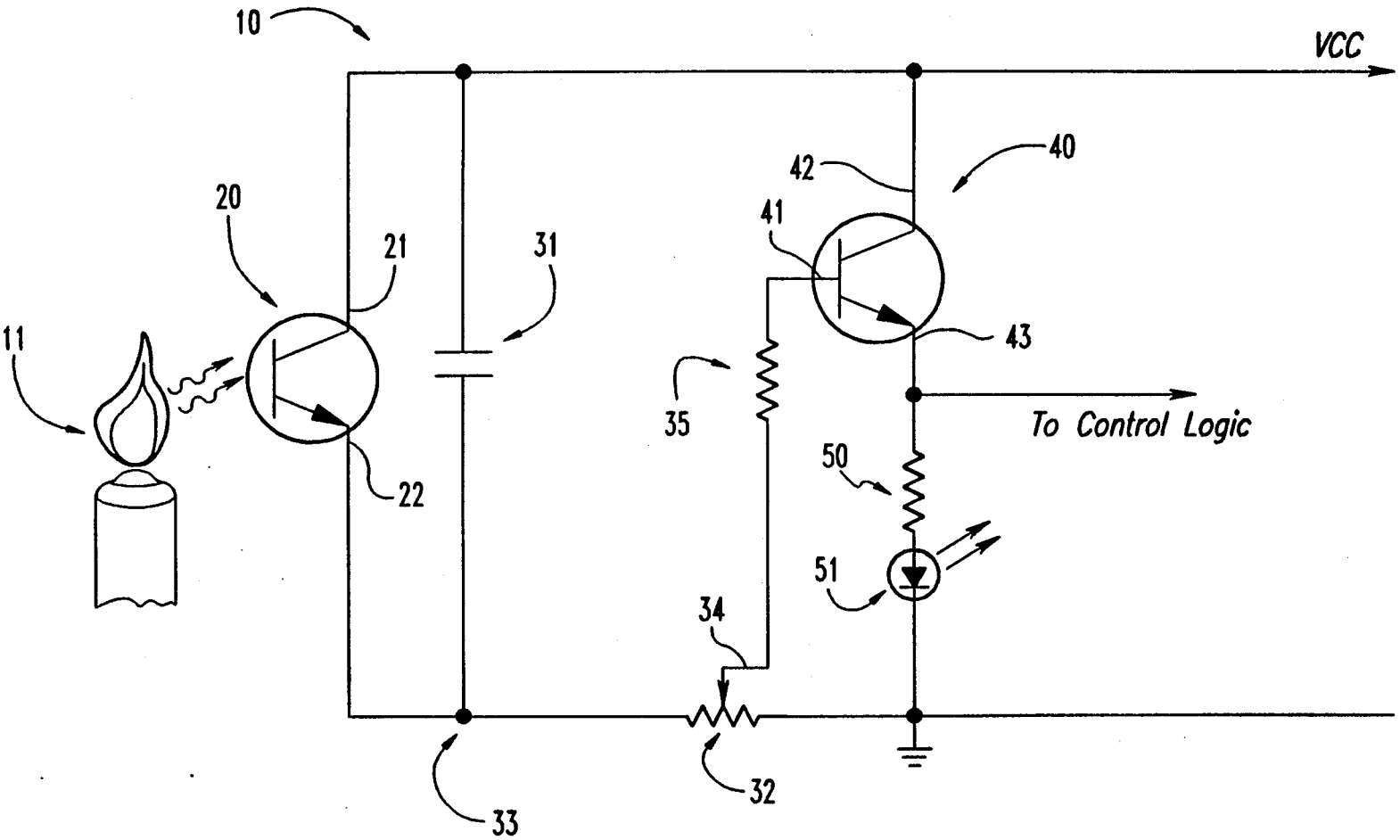
FIG. 1 is a schematic diagram of the circuitry for an infrared flame sensor apparatus according to the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to FIG. 1, there is illustrated a schematic diagram of a preferred embodiment of an infrared flame sensor apparatus 10 useful for remote detection of a gas flame in the combustion chamber of a water heater or boiler (not shown) by sensing the infrared components of the flame 11. The flame sensor apparatus 10 includes a phototransistor 20, having a response at wavelengths primarily in the infrared spectrum, disposed in close proximity to a flame source 11. The phototransistor 20 is connected to a filter means for filtering out transient signals and preventing oscillatory or false signals from triggering the switch means 40. The filter means includes a capacitor 31 and a potentiometer 32. The signal from the filter means is supplied to the switch means via wiper 34. If the signal at wiper 34 is in excess of a predetermined amplitude, a monitoring means will indicate the presence of a signal. In the preferred embodiment the monitoring means comprises a light emitting diode 51. However, it is understood that the monitoring means can be an audible alarm device, such as a horn, for indicating the presence or absence of a flame. Alternatively, control logic can be added to remotely operate either a number of light emitting diodes or a remote alarm device in response to certain flame conditions.

Operation

In describing the circuit operation, reference is made to FIG. 1 in which the preferred embodiment of the infrared flame sensor apparatus is illustrated. A phototransistor 20 is placed in close proximity to a gas flame 11. Though the use of this invention is illustrated in connection with a system having a gas flame rich in infrared components, it is in no way meant to limit the use of this invention to systems where gas flames are present. This invention can be used in any system involving heat or flame where large quantities of infrared radiation are present.

Figure 2:
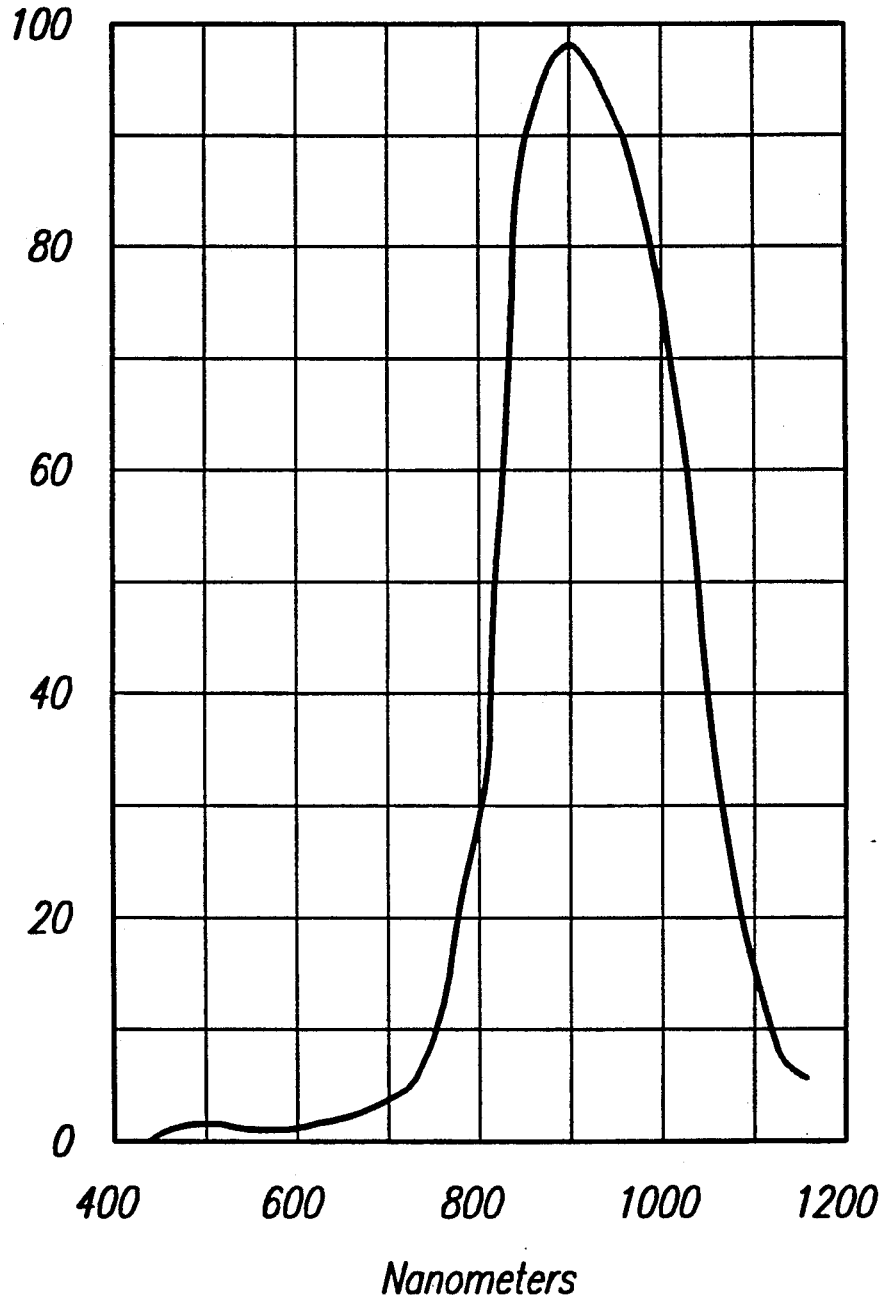
FIG. 2 is a graphical representation of the optimal response curve of an infrared phototransistor.

The infrared radiation spectrum characteristically includes light having wavelengths from around 880 nanometers to around 1 millimeter (1,000,000 nanometers). Referring now to FIG. 2, the phototransistor 20 used in the preferred embodiment of this invention has a spectrally compact response peaking at a wavelength of about 900 nanometers. An example of a phototransistor having the desired response (See FIG. 2) is the TIL78 manufactured by Texas Instruments or the electri similar Siemens model No. SFH309F phototransistor with daylight filter. FIG. 2 is a graphical representation of the response curve of the Siemens model No. SFH309F phototransistor. As shown in FIG. 2, the phototransistor 20 is sensitive to light signals having wavelengths between 800 and 1100 nanometers, and having a maximum photosensitivity to light having a wavelength of approximately 900 nanometers. The vertical axis in FIG. 2 represents the spectral sensitivity or output signal for a given wavelength.

The phototransistor 20 has a collector 21 and an emitter 22. The collector 21 is connected to a voltage VCC, such as 6 volts, in order to properly dc bias the phototransistor 20. The emitter 22 is connected in parallel to filtering means components 31 and 32. Infrared radiation incident upon the phototransistor 20 supplies energy that liberates bound electrons and allows a current to flow proportional to the amount of incident infrared radiation.

The emitter terminal 22 is connected to the input node 33 of the filter means. The signal leaves the phototransistor 20 and enters the filter means node 33. The filter means is comprised of a .01 microfarad capacitor 31 and a 20 Kohm potentiometer 32. Capacitor 31 is connected in parallel with the phototransistor 20. Capacitor 31 filters out transient signals and prevents the indication of false or oscillatory signals from the phototransistor. The value of potentiometer 32 is responsible for determining the time constant for the charge/discharge rate of the capacitor 31. The charge/discharge rate helps to stabilizes the signal present at wiper 34 and prevent oscillatory switching of the switch means 40 due to flame flicker. Wiper 34 of potentiometer 32 is adjusted to establish the threshold switching point of transistor 40.

The switch means 40 is a conventional NPN transistor. Resistor 35 has a resistance of 1 Kohm and serves as a current limiting resistor. The switch means input is the base 41 of the transistor 40. The collector 42 of transistor 40 is connected to VCC in order to properly DC bias the transistor 40. The transistor 40 is "on" and conducting when it is in saturation mode. This occurs when the voltage at the base 41 exceeds the emitter voltage by at least 0.7 volts. Potentiometer 32 is adjusted so that when a sufficiently large flame is present the transistor is saturated. Thus, when sufficient infrared radiation is detected the switch means 40 is turned "on". Conversely, when only a small flame or no flame is present, the transistor is in the cutoff range and the switch means 40 is turned "off".

In this particular embodiment, when the transistor 40 is saturated a monitoring means or LED 51 will indicate the presence of a signal. The LED 51 is illuminated when it is forward biased. The LED 51 is illuminated when the transistor 40 is saturated. In order to properly dc bias circuit 10, VCC should be approximately 6 volts dc. When the silicon transistor 40 is in saturation mode, the emitter voltage is equal to about 5.9 volts since $V_e = V_c$ (VCC in this embodiment) -0.1 v. The emitter voltage is in excess of the 1.3 v drop necessary to turn on the monitoring means (LED 51), thus signalling the detection of infrared radiation at the phototransistor. The voltage $V_e$ appears across the resistor 52 and LED 51. Resistor 50 limits current through LED 51. Alternatively, control logic can be connected between the emitter 43 and ground to enable remote monitoring of the status of transistor 40 and remotely indicate flame condition.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed:

1. A flame sensing apparatus for detecting infrared light radiating from a flame present in a combustion chamber of a water heater or boiler, said apparatus comprising:

a phototransistor disposed in close proximity to the flame and producing a signal in response to light wavelengths in the infrared spectrum, said phototransistor having an emitter terminal and a collector terminal;

transient filter means for filtering out transient signals in order to prevent false or oscillatory signal indications from occurring in response to said signal from said phototransistor, said transient filter means having a filter input and a filter output, said emitter terminal connected to said input of said transient filter;

switch means having a switch input and a switch output, said transient filter output connected to said switch input, said switch conducting in response to signals appearing at said input terminal;

monitoring means connected to said switch output for indicating the presence of a signal in excess of a predetermined amplitude at said switch output.

2. The apparatus according to claim 1 wherein said monitoring means is a visual indicator.

3. The apparatus according to claim 2 wherein said monitoring means is a light emitting diode.

4. The apparatus according to claim 1 wherein said monitoring means is an audible noise indicating device.

5. The apparatus according to claim 1 wherein said monitoring means is an apparatus for remotely indicating the presence of a signal at the output of the switch means.

6. The apparatus according to claim 1 wherein said transient filter means is a capacitor in parallel with a resistor.

7. The apparatus according to claim 6 wherein said resistor is a variable resistor.

8. The apparatus according to claim 7 wherein said switch means is an NPN transistor.

9. A flame sensing apparatus for detecting infrared light radiating from a gas flame present in a combustion chamber of a water heater or boiler, said apparatus comprising:

a phototransistor disposed in close proximity to the gas flame and producing a signal in response to light wavelengths in the infrared spectrum, said phototransistor having an emitter terminal and a collector terminal;

transient filter means for filtering out transient signals in order to prevent false or oscillatory signal indications from occurring in response to said signal from said phototransistor, said transient filter means having a filter input and a filter output, said emitter terminal connected to said input of said transient filter;

a transistor operating in either saturation or cutoff mode said transistor having a base input terminal connected to said filter output, a collector terminal connected to a fixed voltage and an emitter output terminal;

an indicator means connected to the emitter of the NPN transistor for indicating the presence of a signal in excess of a predetermined amplitude present at said transistor emitter output terminal when said transistor is saturated.

10. The apparatus of claim 9 wherein said transient filter means is a capacitor in parallel with a resistor.

11. The apparatus of to claim 10 wherein said resistor is a variable resistor.

12. The apparatus of claim 11 wherein said indicator means is an LED.

* * * * *